US005876650A

United States Patent [19]

Burlone et al.

[11] Patent Number: 5,876,650

[45] Date of Patent: Mar. 2, 1999

[54] PROCESS OF MAKING FIBERS OF ARBITRARY CROSS SECTION

[75] Inventors: Dominick A. Burlone, Asheville, N.C.; Olli-Pekka Tuominen, North Ogden, Utah

[73] Assignee: BASF Corporation, Mt. Olive, N.J.

[21] Appl. No.: 982,024

[22] Filed: Dec. 1, 1997

[51] Int. Cl.[6] ..... D01D 5/04; D01D 5/092; D01D 5/253; D01F 6/00

[52] U.S. Cl. ..... 264/172.11; 264/172.12; 264/172.13; 264/172.14; 264/172.15; 264/172.16; 264/172.17; 264/172.18; 264/177.13

[58] Field of Search ..... 264/172.11, 172.12, 264/172.13, 172.14, 172.15, 172.16, 172.17, 172.18, 177.13

[56] References Cited

U.S. PATENT DOCUMENTS

| | | | |
|---|---|---|---|
| 2,932,079 | 4/1960 | Dietzsch et al. | 428/374 |
| 2,987,797 | 6/1961 | Breen | 428/370 |
| 3,350,488 | 10/1967 | Breen | 264/172.17 |
| 3,672,802 | 6/1972 | Matsui et al. | 425/131.5 |
| 3,846,507 | 11/1974 | Thomm et al. | 525/432 |
| 4,008,344 | 2/1977 | Okamoto et al. | 428/374 |
| 4,233,355 | 11/1980 | Sato et al. | 442/195 |
| 4,460,649 | 7/1984 | Park et al. | 428/373 |
| 4,639,397 | 1/1987 | Sato et al. | 428/397 |
| 4,966,808 | 10/1990 | Kawano | 442/201 |
| 5,087,327 | 2/1992 | Hood | 162/358 |
| 5,124,194 | 6/1992 | Kawano | 442/201 |
| 5,158,810 | 10/1992 | Oishi et al. | 428/35.4 |
| 5,162,074 | 11/1992 | Hills | 216/83 |
| 5,208,104 | 5/1993 | Ueda et al. | 428/364 |
| 5,308,697 | 5/1994 | Muramoto et al. | 428/373 |
| 5,366,804 | 11/1994 | Dugan | 428/373 |
| 5,395,693 | 3/1995 | Cho et al. | 428/373 |
| 5,405,698 | 4/1995 | Dugan | 428/373 |
| 5,422,420 | 6/1995 | Shridharani | 528/349 |

*Primary Examiner*—Leo B. Tentoni

[57] ABSTRACT

The present invention relates, in general, to fiber spinning and, in particular, to a process of spinning fibers of more than one cross-sectional component and to fibers produced thereby.

14 Claims, 1 Drawing Sheet

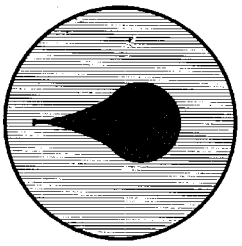
FIGURE 1A
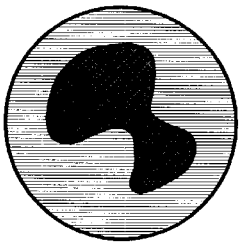
FIGURE 1B
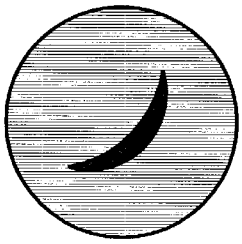
FIGURE 1C
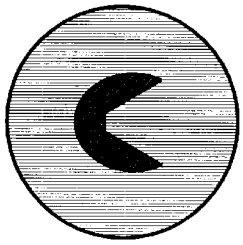
FIGURE 1D
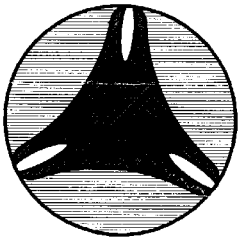
FIGURE 1E
FIGURE 2A
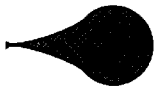
FIGURE 2B
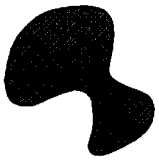
FIGURE 2C
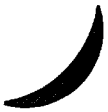
FIGURE 2D
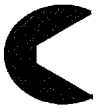
FIGURE 2E
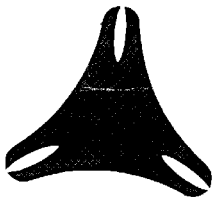

PROCESS OF MAKING FIBERS OF ARBITRARY CROSS SECTION

TECHNICAL FIELD

The present invention relates, in general, to fiber spinning and, in particular, to a process of spinning fibers of more than one cross-sectional component and to fibers produced thereby.

BACKGROUND

Various types of fibers having two or more cross-sectional components (ie multi-component fibers) are well known in the art, as are processes for their production. Examples of such fibers and production processes are set forth in U.S. Pat. Nos. 4,233,355 and 4,460,649.

Multicomponent fibers have been used to generate micro- or ultrafine filaments (see, for example, U.S. Pat. Nos. 4,233,355, 4,966,808, 5,124,194 and 5,366,804). The fibers can be split into their components using mechanical or chemical (eg solvent) means. In U.S. Pat. No. 4,233,355, for example, microfibers are generated from multicomponent (composite) fibers by selective dissolution of one of the components of the composite fiber using a solvent in which the microfibrous component is relatively insoluble.

The art does not include a description of a method of producing a fiber of virtually any cross sectional shape from a composite fiber having a preselected relative arrangement of components of differing solubility in a given solvent. The present invention provides such a process.

OBJECTS AND SUMMARY OF THE INVENTION

It is a general object of the invention to provide a process of producing a fiber of virtually any cross sectional shape.

It is a specific object of the invention to provide a process of producing a fiber of predetermined cross sectional shape from a composite fiber that includes at least two components that have different solubility characteristics and that are in a selected relative arrangement.

It is a further object of the invention to provide a composite fiber comprising at least two components having differing solubility characteristics (eg water solubility characteristics).

The foregoing objects are met by a composite fiber having two or more cross sectional components comprising different materials (eg polymers), one of those materials being more soluble in a particular solvent (eg water) than other. The components are present in a predetermined relative arrangement so that, upon dissolution of the more soluble component in the solvent, the relatively insoluble component remains as a fiber having a predetermined cross sectional shape.

Further objects and advantages of the invention will be clear from the description that follows.

BRIEF DESCRIPTION OF THE DRAWINGS

FIGS. 1A–E show cross sectional views of composite fibers comprising components having different solubility characteristics.

FIGS. 2A–E show cross sectional views of fibers resulting from dissolution of the soluble component of the composite fibers shown in FIG. 1.

DETAILED DESCRIPTION OF THE INVENTION

The present invention relates, in one embodiment, to a process of preparing fibers of various cross sections, including cross sections not easily achievable using conventional melt spinning techniques. The process comprises preparing a composite fiber comprising at least two components having different solubility characteristics in a given solvent. The components are positioned in the composite fiber relative to each other such that, upon dissolution of one of the components in the solvent, the component more insoluble in that solvent remains as a fiber having the desired cross sectional shape.

Depending on the orientation of component materials, a variety of composite fiber cross sections and component fiber shapes can be achieved (see, for example, FIGS. 1A–B and 2A–B ). By removal of the more soluble or dispersible component, component fiber shapes can be achieved that are difficult to obtain through direct extrusion because of surface tension effects that otherwise tend to 'round out' cross sectional features after extrusion.

While advantage can be taken of differing solubility characteristics with respect to a variety of solvents (including polar solvents such as water, acetone, alcohols, dimethylformamide (DMF), methyl ethyl ketone (MEK) and cellosolves), the present invention will be described in detail with respect to differing water solubility characteristics (the terms "water soluble" and "water insoluble" being used below merely for purposes of clarity). Further, it will be appreciated from a reading of the following that the multicomponent fiber can include a plurality of components of differing solubility characteristics. The description that follows, however, will focus on a bicomponent, composite fiber.

Production of the composite fiber of the invention can be achieved using conventional spinning techniques (eg melt spinning techniques). The water insoluble component can be supplied to the fiber spinning apparatus simultaneously with the supplying to that apparatus of the water soluble component. In the spinning apparatus, the water soluble and water insoluble components are arranged in a predetermined relative arrangement to achieve a selected cross sectional shape of the water insoluble component. The water soluble and water insoluble components are extruded from the spinning apparatus in the predetermined arrangement. The water soluble component is removed by dissolution in an aqueous solution so that the water insoluble component remains in the selected cross sectional shape adopted as a result of the presence of the water soluble component in the spinneret.

The components of the composite fiber (eg component polymers) can be supplied to the spinning apparatus, for example, via a transfer line, using conventional methods, including pumping under positive pressure. Thermoplastic polymer components are melted at appropriate temperatures (eg about 10° C. to about 75° C. higher than the polymer melt point) prior to pumping. Independent supply mechanisms can be used for each component. Various methodologies can be used to selectively arrange the components of the composite fiber in the spinning apparatus in a predetermined relative arrangement. Particularly advantageous is the method disclosed in U.S. Pat. No. 5,162,074 which utilizes distributor plates in which distributor flow paths are etched on one or both sides to distribute polymer components to appropriate spinneret hole locations. The etching process permits the distribution path to be sufficiently small to facilitate issuing multiple discrete polymer component streams axially into each spinneret orifice inlet hole.

Polymer components can be extruded through the spinneret orifices, which can be a variety of shapes. In the case of melt spun polymers, extrusion can be into a quench chimney to form filaments cooled by a flow of gaseous medium, such as air, which hardens the filaments. When dry spinning is used, the quench conditions are selected so as to effect removal of the solvent. The use of hot air or hot, dry air is typical. As above, the conditioned air flows over the filament as the filament passes through the quench chimney. (Composite fibers of the invention can also comprise a melt spun core insoluble component (eg a polypropylene melt) and a polymer solution soluble sheath component (eg a solution of polyvinylpyrrolidine (PVP) in ethanol). Such composite fibers need not undergo a solvent removal step prior to dissolution of the soluble component (eg PVP).)

After extrusion, the water soluble component is removed. Removal can be effected, for example, by passing the fiber (eg after quenching (or solvent removal)) through a bath that contains a solvent in which the water soluble component is soluble (eg water) under conditions such that solubilization/dissolution occurs. Alternatively, the fiber can be further processed, for example, to staple fiber, and then treated as stock as, for example, in a stock dyeing operation. The fiber and yarn can also be processed into final goods and the finished goods can then be treated with solvent (eg water) to remove the soluble component. This last approach can result in a woven or knit fabric or floor covering having a fiber structure, after dissolution of the water soluble component, that may not be possible to produce without dissolution.

Fibers produced in accordance with the present invention can be processed, for example, using conventional techniques of drawing, texturing, finishing etc, and can be colored using pigments or dyes. The insoluble component, for example, can include heat or light stabilizers.

End use applications of the fibers of the invention include typical textile applications in apparel, home furnishings or industrial products in which the resulting fiber cross section enhances function, performance, properties, or aesthetics. Fiber cross sections achievable by the invention can enhance tactile and comfort properties, alter luster and light reflecting properties, enhance covering power, enhance absorbtivity and wicking power and alter bend modulus and crimp ability.

Suitable insoluble component materials include melt-spun polymers, for example, nylon 6 and 66, polyester, polyethylene and polypropylene. Suitable soluble or dispersible components include copolymers of the same as well as soluble homopolymers such as polycaprolactone and polyethylene oxides. The insoluble or undispersible components can be solubilized with comonomers that contain solubilizing or dispersing functional groups, such as vinyl, sulfonate, phosphonate or ethoxylate groups.

In a specific embodiment of the invention, nylon or polyester is used as the water insoluble component and a melt spinnable polymer such as described in U.S. Pat. No. 3,846,507 (eg water soluble polyamide as described therein) can be used as the water soluble component. In accordance with this embodiment, nylon-6 with a water- or solvent-soluble sulfonated polyamide so that the insoluble nylon-6, for example, is coextruded as the core component and the soluble sulfonated polyamide is the sheath component. These components can be oriented such that a composite fiber is produced having, for example, a half barbell-shaped core imbedded in a fiber with an overall round cross section. Because the overall cross section is round, it will tend to retain its shape and will not distort after extrusion. After removal of the soluble component from the composite fiber using, for example, water or steam, a half barbell-shaped inner core remains as the final fiber. Any of a variety of alternative inner core structures can be achieved in accordance with the invention (see, for example FIGS. 2A–2E).

The following further non-limiting Example describes certain aspects of the invention in greater detail.

EXAMPLE

Nylon-6 chips and sulfonated nylon are melted in separate single-screw extruders and pumped via separate gear pumps to a bicomponent spin pack. The spin pack consists of filters and distribution plates that separately route the polymers to the backhole of a capillary in a spinnerette. The spinnerette contains a number of holes depending on the desired number of fibers in the yarn, desired throughout, etc. After extrusion, the fibers pass through a quench zone in which cool air solidifies the molten polymers. The threadline is then passed over a series of guides immersed in a hot water bath. After the bath, the threadline is air- or steam-textured and wound or cut into staple fiber.

All documents cited above are hereby incorporated in their entirety by reference.

One skilled in the art will appreciate from a reading of this disclosure that various changes in form and detail can be made without departing from the true scope of the invention.

What is claimed is:

1. A process for preparing a fiber comprising:

a) supplying a first spinnable polymer or polymer solution to a fiber spinning apparatus;

b) simultaneously supplying to said apparatus a second spinnable polymer or polymer solution, co-spinnable with said first polymer or first polymer solution, selected from the group consisting of copolymers of polyamides, copolymers of polyolefins, copolymers comprising comonomers containing solubilizing or dispersing functional groups, and soluble homolpolymers, wherein said second polymer or second polymer solution is more soluble or dispersible in a solvent than said first polymer or first polymer solution;

c) in the fiber spinning apparatus, arranging said first polymer or first polymer solution and said second polymer or second polymer solution in a predetermined relative arrangement to achieve a selected cross sectional shape of said first polymer or first polymer solution, said cross sectional shape being rounded, but non-circular;

d) extruding from the spinning apparatus a filament of said first polymer or first polymer solution and said second polymer or second polymer solution in the predetermined relative arrangement; and e) contacting said filament resulting from step (d) with said solvent under conditions such that substantially all of said second polymer or second polymer solution dissolves or disperses in said solvent and said first polymer or first polymer solution remains in said selected cross sectional shape.

2. The process of claim 1 wherein said solvent is a polar solvent.

3. The process of claim 2 wherein said solvent is water, a ketone, an alcohol, an ether, an ester or an amide.

4. The process according to claim 3 wherein said ketone is acetone or a methyl or ethyl ketone.

5. The process according to claim 3 wherein said amide is dimethylformamide.

6. The process of claim 1 wherein said first polymer is supplied to said fiber spinning apparatus in step (a).

7. The process of claim 6 wherein said first polymer is a melt spinnable polymer.

8. The process of claim 7 wherein said first polymer is nylon, polyester, polyethylene, or polypropylene.

9. The process of claim 1 wherein said second polymer is supplied to said spinning apparatus in step (b).

10. The process according to claim 1 wherein said functional groups are vinyl, sulfonate, phosphonate or ethoxylate groups.

11. The process according to claim 1 wherein said homopolymer is a polycaprolactone or a polyethylene oxide.

12. The process of claim 6 wherein said second polymer is supplied to said spinning apparatus in step (b).

13. The process according to claim 12 wherein said homopolymer is a polycaprolactone or a polyethylene oxide.

14. The process according to claim 12 wherein said functional groups are vinyl, sulfonate, phosphonate or ethoxylate groups.

* * * * *

UNITED STATES PATENT AND TRADEMARK OFFICE

CERTIFICATE OF CORRECTION

PATENT NO. : 5,876,650

DATED : March 2, 1999

INVENTOR(S) : Dominick A. Burlone et al.

It is certified that error appears in the above-indentified patent and that said Letters Patent is hereby corrected as shown below:

At column 4, line 38, please delete "homolpolymers" and replace it with "homopolymers".

Signed and Sealed this

Twentieth Day of July, 1999

*Attest:*

*Attesting Officer*

Q. TODD DICKINSON

*Acting Commissioner of Patents and Trademarks*